US005762219A

United States Patent [19]

Parrinello

[11] Patent Number: 5,762,219

[45] Date of Patent: Jun. 9, 1998

[54] PLASTIC SCREW CAP FOR CLOSING CONTAINERS

[75] Inventor: Fiorenzo Parrinello, Medicina, Italy

[73] Assignee: Sacmi Cooperativa Meccanici Imola S.c.r.l., Imola, Italy

[21] Appl. No.: 735,183

[22] Filed: Oct. 22, 1996

[30] Foreign Application Priority Data

Oct. 24, 1995 [IT] Italy ..... B0950151 U

[51] Int. Cl.[6] ..... B65D 53/04

[52] U.S. Cl. ..... 215/351; 215/341; 215/DIG. 1

[58] Field of Search ..... 215/341, 343, 215/344, 349, 350, 351, DIG. 1

[56] References Cited

U.S. PATENT DOCUMENTS

| | | | |
|---|---|---|---|
| 3,022,918 | 2/1962 | Smith . | |
| 4,076,152 | 2/1978 | Mumford . | |
| 4,407,422 | 10/1983 | Wilde et al. . | |
| 4,462,502 | 7/1984 | Luenser et al. | 215/350 X |
| 4,629,083 | 12/1986 | Druitt . | |
| 4,668,458 | 5/1987 | Whitney | 215/351 X |
| 4,721,221 | 1/1988 | Barriac | 215/350 |
| 4,957,211 | 9/1990 | Ekkert et al. | 215/349 X |
| 5,064,084 | 11/1991 | McBride et al. | 215/350 |
| 5,285,913 | 2/1994 | Morton | 215/350 X |
| 5,462,187 | 10/1995 | Gregory et al. | 215/350 |

FOREIGN PATENT DOCUMENTS

| | | | |
|---|---|---|---|
| 2 108 892 | 5/1983 | United Kingdom . | |
| 81/00838 | 4/1981 | WIPO | 215/350 |

*Primary Examiner*—Stephen Cronin
*Assistant Examiner*—Nathan Newhouse
*Attorney, Agent, or Firm*—Guido Modiano; Albert Josif

[57] ABSTRACT

A plastic screw cap for closing a container, including a cup composed of a disk-like portion and a cylindrical wall that protrudes from the rim of said disk-like portion and has an internal thread that is adapted to engage a corresponding thread of the container, the cap further comprising an annular lip that protrudes from the disk-like portion concentrically with respect to the cylindrical wall, the annular lip acting as a shoulder for a sealing liner, so that the liner, when the cap has been applied to the container, frontally and externally engages the rim of the mouth of the container.

20 Claims, 4 Drawing Sheets

PLASTIC SCREW CAP FOR CLOSING CONTAINERS

BACKGROUND OF THE INVENTION

The present invention relates to a plastic screw cap for closing containers.

Screw caps of this type are already commercially available.

They generally comprise a cup composed of a cylindrical wall that protrudes from the peripheral region of a disk-like portion adapted to close the mouth of the container. On the inside of the cylindrical wall there is provided a thread adapted to engage, by screwing, a corresponding thread of the container.

A tamper-evident ring is coupled to the rim of the cup by means of breakable bridges and has means for engaging a collar of the container. When the cap is unscrewed, the ring abuts against said collar, breaking the bridges and clearly indicating that the container has been tampered with owing to the fact that the ring remains coupled below the collar.

In order to ensure hermetic closure of the container, on the inner face of the disk-like portion there are provided sealing means, against which the rim of the mouth (so-called "finish") of the container acts. Said sealing means are substantially of three types. A first type consists of a disk-like liner made of an adapted material that is applied so as to cover the inner face of the disk-like portion. A second type is constituted by a liner that is formed by molding directly inside the cup. An example of a liner of this second type is disclosed in U.S. Pat. No. 4,378,893. This patent also discloses an annular lip that protrudes inwards from the cylindrical wall of the cup proximate to the disk-like portion and retains the peripheral rim of the molded liner.

Finally, a third type of sealing means is constituted by one or more flexible annular lips that protrude concentrically towards the inside of the disk-like portion and adhere to the finish of the container. A closure of this type is described in European patent no. 162,456.

Sealing means that are currently in use have some substantial drawbacks. The sealing means of the first type require the preliminary formation, in auxiliary machines, of the disks to be applied inside the cups, entailing additional operating cycles. The sealing means of the second type require special molds to form the annular lip as an undertuck.

The sealing means of the third type often have insufficient tightness characteristics, since the concentric rings are made of the same material as the cup and are therefore not flexible enough to eliminate all the unevennesses of the finish.

SUMMARY OF THE INVENTION

A principal aim of the present invention is to provide a plastic screw cap that allows to overcome the shortcomings of conventional ones, i.e., is capable of ensuring a high level of tightness and low-cost production.

This aim is achieved with a plastic screw cap for closing a container that comprises a cup composed of a disk-like portion and a cylindrical wall that protrudes from the rim of said disk-like portion and has an internal thread that is adapted to engage a corresponding thread of the container, characterized in that it comprises an annular lip that protrudes from said disk-like portion concentrically with respect to said cylindrical wall, said annular lip acting as a shoulder for a sealing liner, so that said liner, when the cap has been applied to the container, frontally and externally engages the rim of the mouth of the container.

BRIEF DESCRIPTION OF THE DRAWINGS

Further characteristics and advantages of the cap according to the invention will become apparent from the following detailed description of some embodiments thereof, illustrated only by way of non-limitative example in the accompanying drawings, wherein.

DESCRIPTION OF THE PREFERRED EMBODIMENTS

Figure 1:
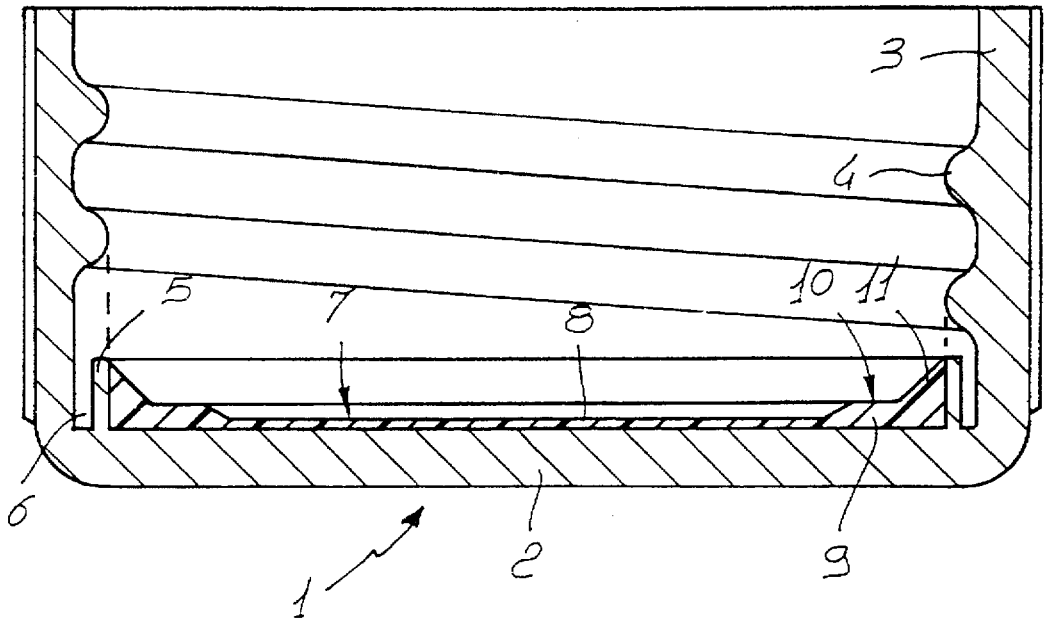
FIG. 1 is a sectional view of a cap.

With reference to FIG. 1, the cap comprises a cup, generally designated by the reference numeral 1, which comprises a disk-like portion 2 from which a cylindrical wall 3, having an internal thread 4, protrudes.

An annular lip 5, coaxial to the cylindrical wall 3, protrudes from the peripheral region of the disk-like portion 2 inside the cap. The diameter of the lip 5 is greater than the inside minor diameter of the thread 4, so that the lip 5 lies within the space occupied axially by the thread but is separated from the wall 3 by an annular slot 6.

The cup 1 is formed by molding plastics, for example polypropylene, polyethylene, or copolymers thereof.

The liner 7 is applied inside the annular lip 5 to hermetically close the mouth of the container on which the cap is to be screwed.

The liner 7 comprises a central thinner region 8 that covers the inner face of the disk-like portion 2. The central region 8 is surrounded by a peripheral annular enlarged portion 9 having, proximate to the lip 5, a flat region 10, from which the thickness increases radially outwards to blend with the lip 5 with a bead 11 having a substantially triangular cross-section.

By virtue of said bead 11 and of the presence of the peripheral slot 6, when the cap is applied to the container C the resulting axial thrust radially widens the annular lip 5, allowing the bead 11 of the liner to externally wrap around the rim of the mouth of the container, whilst said rim is pressed frontally against the flat region 10.

This eliminates front tightness problems arising from any camber of the disk-like portion caused by an increase in the internal pressure of the container. Likewise, the external covering of the rim of the container provided by the bead 11 allows to ensure the tightness of the closure even in case of variations in the diameter of the mouth of the container.

Figure 2:
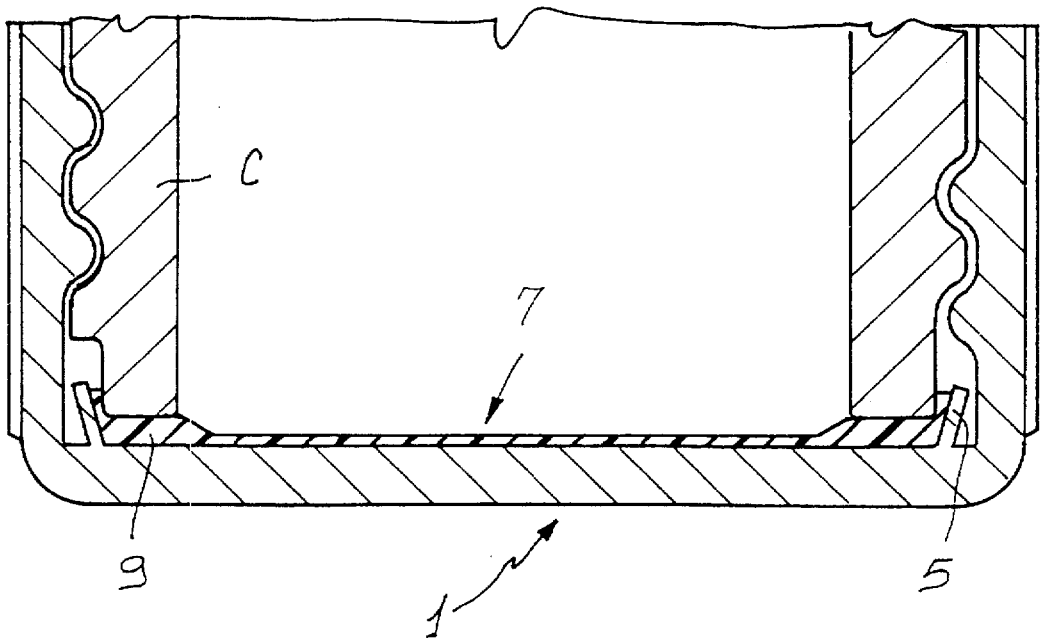
FIG. 2 is a sectional view of the cap of FIG. 1, in the position in which the container is closed.
Figure 3:
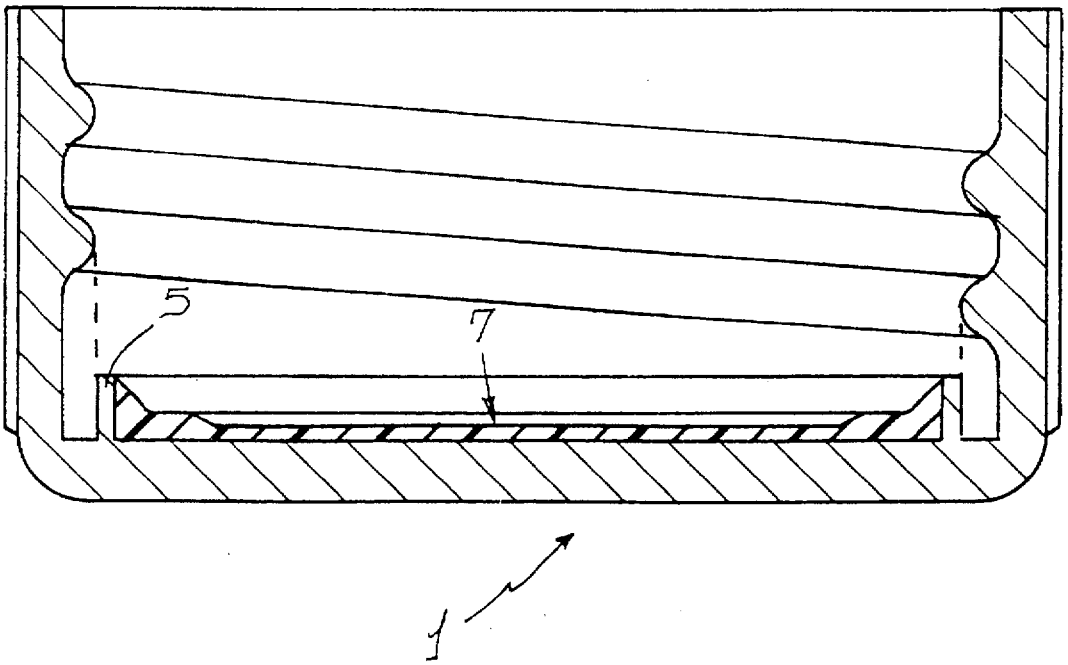
FIGS. 3, 4, and 5 are sectional views of some different embodiments of the cap.

FIG. 3 is a view of a first different embodiment, which differs from the solution shown in FIGS. 1 and 2 owing to the fact that the outside diameter of the annular lip 5 is smaller than the inside diameter of the thread. This solution allows to reduce the stresses on the cap that occur during extraction of the internal molding plunger at the end of the cap molding step.

Figure 4:
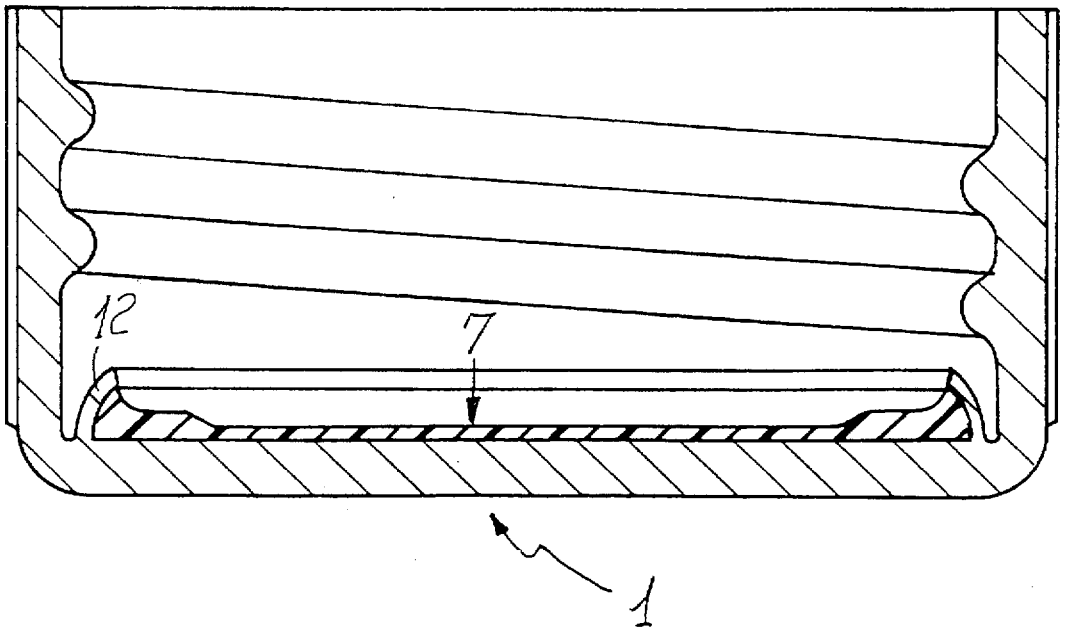

FIG. 4 is a view of a second different embodiment, which provides for an annular lip 12 that converges inwardly to ensure peripheral containment of the liner both during liner molding and when the cap is in the position for closing the container.

Figure 5:
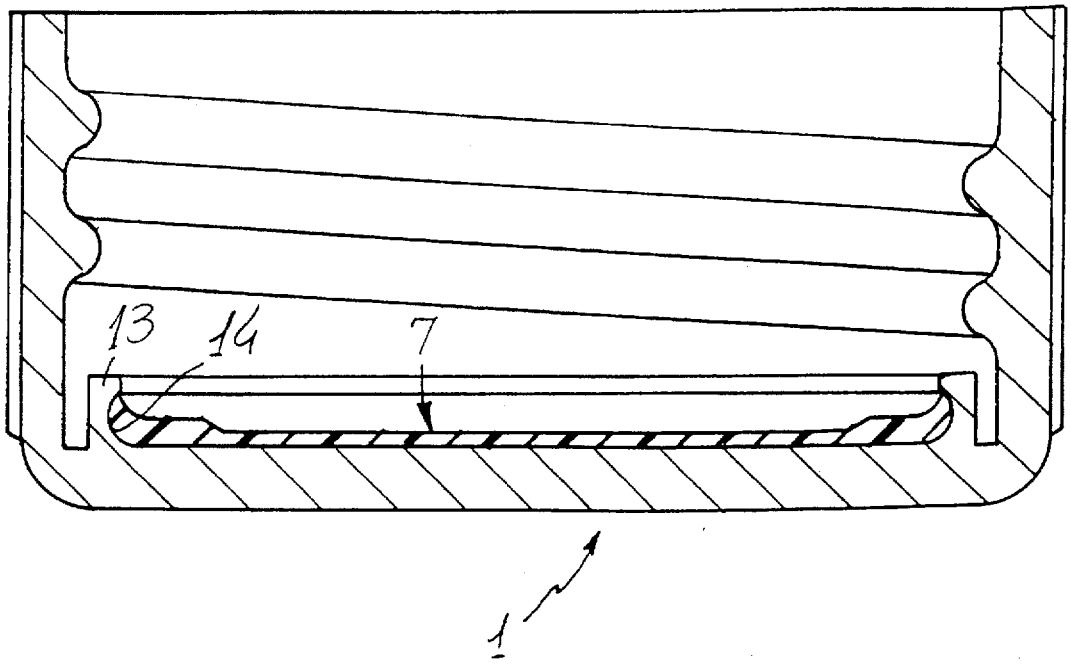
Figure 6:
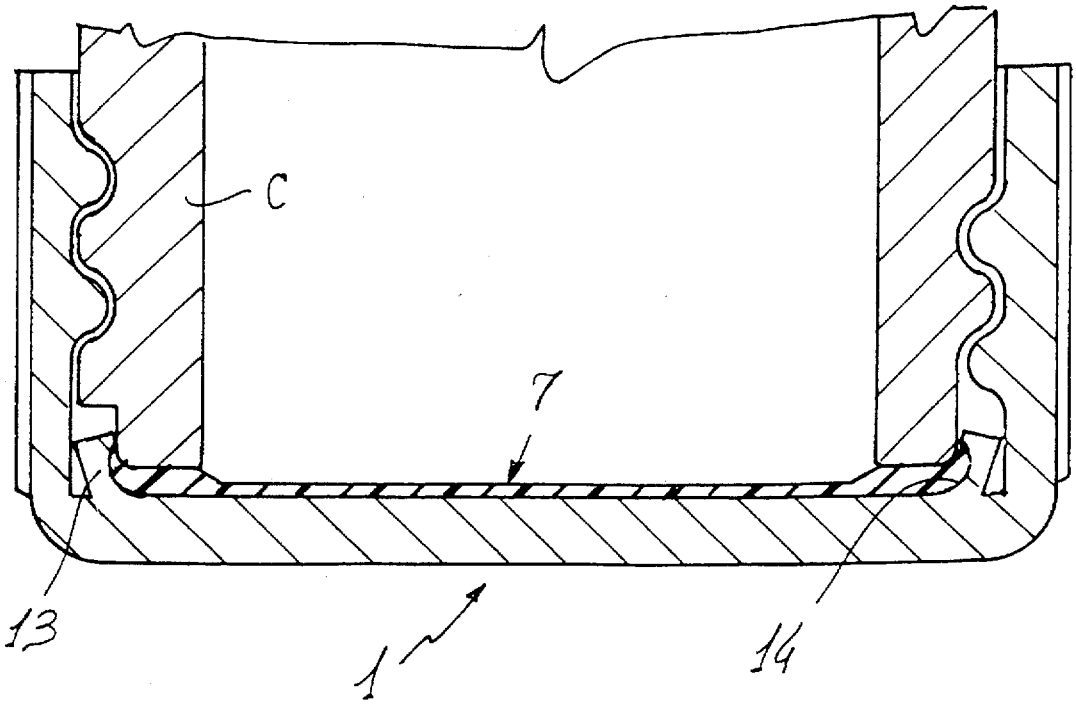
FIG. 6 is a sectional view of the cap of FIG. 5 in the position in which the container is closed.

Likewise, the solution of FIGS. 5 and 6 provides for an annular lip 13 which is internally provided with an annular groove 14.

The lip 13 has such a thickness that when the cap is applied to the container it abuts externally against the inner face of the wall 3, providing a sealing thrust against the inner face of the wall 3 and providing a sealing thrust against the outer rim of the container.

Figure 7:
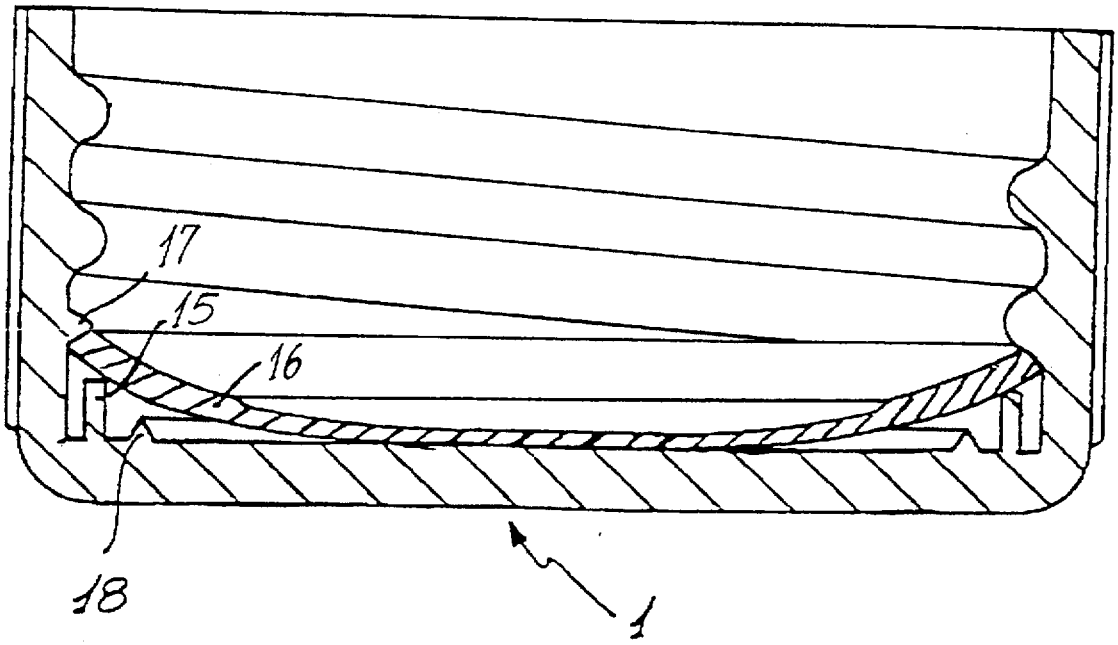
FIG. 7 is a sectional view of a further different embodiment of the cap.
Figure 8:
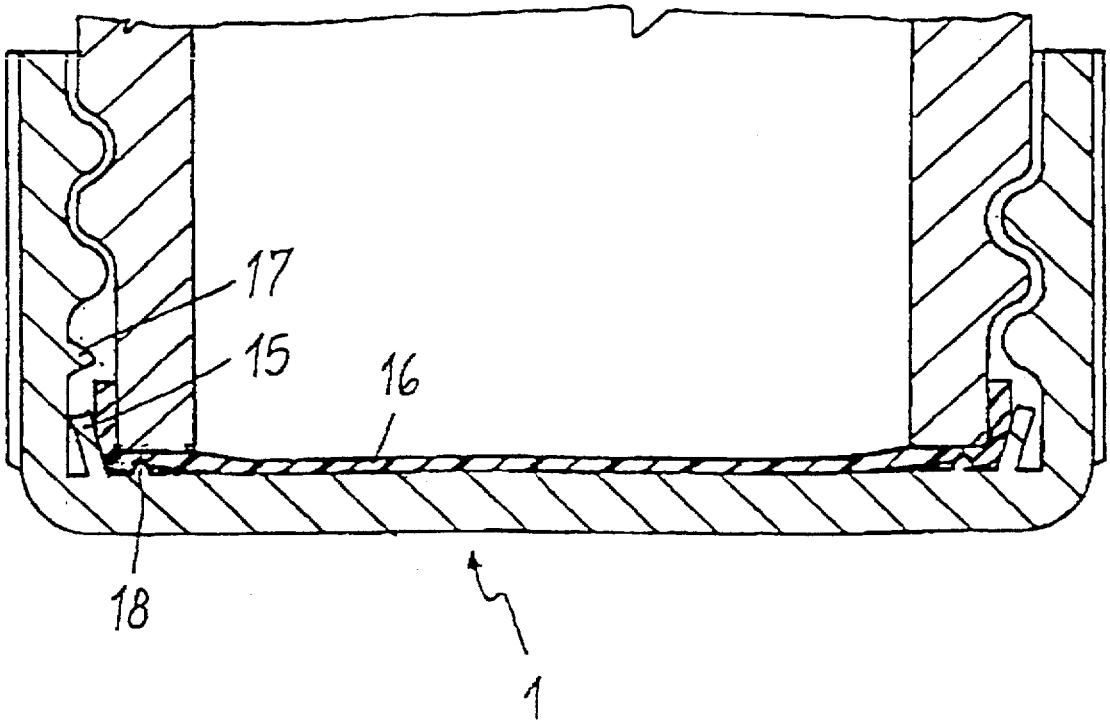
FIG. 8 is a sectional view of the cap of FIG. 7 in the position in which the container is closed.

Finally, FIG. 7 illustrates an embodiment that provides for an annular lip 15 that is similar to those of FIGS. 1 and 2 but differs, with respect to said figures, because of the presence of a disk-like liner 16.

The liner 16 is inserted in the cap, where it is retained by an undertuck 17. In some cases, the undertuck is not necessary and the thread keeps the liner inserted.

When the cap is applied to the container, the rim of the mouth pushes the liner inside the annular lip, which provides the necessary radial sealing thrust by flexing.

Optional cusp-shaped protrusions 18 rising from the disk-like portion of the cup can be provided proximate to the annular lip 15 and, by engaging the liner, prevent it from moving radially once it has been applied to the bottle.

What is claimed is:

1. A plastic screw cap for closing a container, at a mouth rim portion thereof, the rim portion of the container ending in a rim, said cap comprising:

a cup having a disk-like portion and a cylindrical wall, said disk-like portion including a disk rim thereof, and said cylindrical wall protruding from said disk rim, an internal thread being further provided on said cylindrical wall for engaging a corresponding thread of the container to be closed;

an annular lip, protruding concentrically, with respect to said cylindrical wall, from said disk-like portion; and a sealing liner which frontally and externally engages said mouth rim portion for sealingly closing said container with said annular lip acting as a shoulder element for said sealing liner; and wherein said sealing liner has a peripheral annular enlarged portion and a thinner central region covering an inner face of the disk-like portion, said enlarged annular portion surrounding said central portion and having, proximate to the annular lip, a flat region on which the container rim abuts at closing, said container rim pressing frontally against said flat region with an axial thrust determining radial widening of said annular lip.

2. The screw cap of claim 1, wherein said cup with the annular lip are made of a molded plastic material selectable from a group comprising polypropylene, polyethylene and copolymers thereof.

3. The screw cap of claim 1, wherein said liner comprises a bead which is provided around said flat region, said bead having a thickness increasing radially outwards to blend with said annular lip.

4. The screw cap of claim 1, wherein said annular lip is internally provided with a groove for containing an edge part of the liner.

5. The screw cap of claim 1, wherein said internal thread defines an inside minor diameter thereof, said annular lip having an outside diameter that is greater than the minor diameter of said internal thread, a slot being further formed between said cylindrical wall and said lip.

6. The screw cap of claim 1, wherein said internal thread defines an inside minor diameter thereof, said annular lip having an outside diameter that is smaller than the minor diameter of said internal thread, a slot being further formed between said cylindrical wall and said lip.

7. The screw cap of claim 1, wherein said annular lip is internally provided with a groove for containing an edge part of the liner.

8. The screw cap of claim 1, wherein said lip has such a thickness that when the cap is applied to the container it abuts externally against the inner face of said cylindrical wall.

9. In combination, a plastic molded screw cap for closing a container at a mouth rim portion thereof, the rim portion of the container ending in a rim, and sealing means provided at said cap for sealing said rim portion of the container, wherein said cap comprises:

a cup having a disk-like portion and a cylindrical wall, said disk-like portion including a disk rim thereof, and said cylindrical wall protruding from said disk rim, an internal thread being further provided on said cylindrical wall for engaging a corresponding thread of the container to be closed;

an annular lip, protruding concentrically, with respect to said cylindrical wall, from said disk-like portion; and said sealing means comprises:

a sealing liner inserted in said cup and having a peripheral annular enlarged portion and a thinner central region covering an inner face of the disk-like portion, said enlarged annular portion surrounding said central portion and having, proximate to the annular lip, a flat region on which the container rim abuts at closing, said container rim pressing frontally against said flat region with an axial thrust determining radial widening of said annular lip which acts as a shoulder element for the sealing liner.

10. The combination of claim 9, wherein said cup with the annular lip are made of a molded plastic material selectable from a group comprising polypropylene, polyethylene and copolymers thereof.

11. The combination of claim 9, wherein said liner comprises a bead which is provided around said flat region, said bead having a thickness increasing radially outwards to blend with said annular lip.

12. The combination of claim 9, wherein said annular lip is internally provided with a groove for containing an edge part of the liner.

13. The combination of claim 9, wherein said internal thread defines an inside minor diameter thereof, said annular lip having an outside diameter that is greater than the minor diameter of said internal thread, a slot being further formed between said cylindrical wall and said lip.

14. The combination of claim 9, wherein said internal thread defines an inside minor diameter thereof, said annular lip having an outside diameter that is smaller than the minor diameter of said internal thread, a slot being further formed between said cylindrical wall and said lip.

15. The combination of claim 9, wherein said annular lip is internally provided with a groove for containing an edge part of the liner.

16. The combination of claim 9, wherein said lip has such a thickness that when the cap is applied to the container it abuts externally against the inner face of said cylindrical wall.

17. In combination, a plastic molded screw cap for closing a container at a mouth rim portion thereof, the rim portion of the container ending in a rim, and sealing means provided at said cap for sealing said rim portion of the container, wherein said cap comprises:

a cup having a disk-like portion and a cylindrical wall, said disk-like portion including a disk rim thereof, and said cylindrical wall protruding from said disk rim, an internal thread being further provided on said cylindrical wall for engaging a corresponding thread of the container to be closed;

an annular lip, protruding concentrically, with respect to said cylindrical wall, from said disk-like portion; and said sealing means comprises:

a sealing liner molded in said cup and having a peripheral annular enlarged portion and a thinner central region covering an inner face of the disk-like portion, said enlarged annular portion surrounding said central portion and having, proximate to the annular lip, a flat region on which the container rim abuts at closing, said container rim pressing frontally against said flat region with an axial thrust determining radial widening of said annular lip which acts as a shoulder element for the sealing liner.

18. The combination of claim 17, wherein said cup with the annular lip are made of a molded plastic material selectable from a group comprising polypropylene, polyethylene and copolymers thereof.

19. The combination of claim 17, wherein said liner comprises a bead which is provided around said flat region, said bead having a thickness increasing radially outwards to blend with said annular lip.

20. The combination of claim 17, wherein said annular lip is internally provided with a groove for containing an edge part of the liner.

* * * * *